United States Patent [19]

Skoien

[11] 4,315,962

[45] Feb. 16, 1982

[54] INSULATION BATTS

[76] Inventor: Ralph W. Skoien, 53 Grove Rd., Rosanna, Victoria, Australia

[21] Appl. No.: 166,790

[22] Filed: Jul. 8, 1980

Related U.S. Application Data

[63] Continuation-in-part of Ser. No. 964,044, Nov. 27, 1978, abandoned.

[51] Int. Cl.[3] ..... B32B 9/06; B32B 3/20; B32B 3/22

[52] U.S. Cl. ..... 428/12; 156/297; 428/101; 428/119; 428/188; 428/189; 428/920; 428/319.1

[58] Field of Search ..... 428/12, 101, 119, 188, 428/189, 191, 464, 920; 52/408; 156/60, 297

[56] References Cited

U.S. PATENT DOCUMENTS

| | | | |
|---|---|---|---|
| 2,221,309 | 11/1940 | Gazelle | 428/464 |
| 2,943,965 | 7/1960 | Stogre | 428/464 |
| 3,314,846 | 4/1967 | Niwa | 428/12 |
| 3,814,659 | 6/1974 | Nadeau | 428/920 |

*Primary Examiner*—Paul J. Thibodeau

[57] ABSTRACT

An insulation batt comprising at least two sheets of heat reflecting material, the sheets being secured in overlapping substantially parallel relation by strips extending therebetween and secured thereto, the strips permitting relative movement of the sheets such that they may be moved from a first position in which they are closely juxtaposed in substantially face to face relation and a second position in which they are spaced to provide an insulating air space therebetween.

4 Claims, 11 Drawing Figures

INSULATION BATTS

BACKGROUND OF THE INVENTION (i) Field of the Invention

This invention relates to insulating material.

(ii) Prior Art

A number of materials are used to provide insulation in the ceiling of buildings. Current practice is to use fibrous material which either is of a loose form that is blown into a roof cavity or in the form of batts that are positioned over a ceiling. However, such fibrous material, in either form, has a number of disadvantages including high cost. A further significant disadvantage is the danger of operators who risk inhaling fine fibres, and thereby incurring lung damage.

The present invention seeks to provide an improved insulation material comparable in performance to that of such fibrous material but which obviates or minimizes such disadvantages.

SUMMARY OF THE INVENTION

The invention provides an insulation batt comprising: two rectangular sheets of heat reflecting material; and a plurality of strips secured to said sheets and extending between said sheets and securing said sheets in overlapping substantially parallel relation, said strips extending in substantially parallel spaced relation between said sheets, said strips permitting relative movement of said sheets whereby either one or both of the sheets can be moved from a first position in which the sheets are in substantially face to face contact but wherein one longitudinal edge portion of each sheet, which extends in the same direction as said strips and does not have a strip projecting therefrom, overlaps a longitudinal edge portion of the other strip, to a second position in which the sheets are spaced from one another and wherein the said longitudinal edge portions no longer overlap, said second position providing an insulating air space between the sheets, said strips and said sheets being formed of laminated paper and metal foil.

The strips each may comprise a central web having a side margin at each longitudinal edge thereof and folded with respect to the web portion. Each side margin may be connected to a surface of a respective sheet of reflective material and, by virtue of a fold line between each margin and the web portion, permits movement of the sheets between their first and second positions. Each strip preferably has its marginal portions folded to the one side of the web portion thereof such that the strips are of channel form when the sheets are in their second position.

The insulating batts may be transported with their sheets in the first position, in which the batts are of minimal thickness. The batts therefore can be readily transported or stored, with negligible space requirements.

The sheets may be moved relative to each other by pulling the longitudinal edge portion of one sheet, in a direction transverse to the strips, relative to the other sheet. When so moved, the web of each strip is moved so as to lie edgewise between the sheets, preferably with the width dimension of the webs substantially perpendicular to the sheets, so as to space the sheets.

The sheets of heat reflecting material may be formed of paper with metal foil laminated to both sides thereof.

In addition, the insulation batt may double as a ceiling panel in which case the lowermost sheet which forms the ceiling surface has a layer of foamed plastics material, such as foamed polyurethane or polyethylene, adhered to it. Other conventional ceiling panel coatings may likewise be used in conjunction with the batt.

BRIEF DESCRIPTION OF THE DRAWINGS

This invention is further described with reference to the accompanying drawings in which.

DETAILED DESCRIPTION OF THE PREFERRED EMBODIMENT

Figure 1:
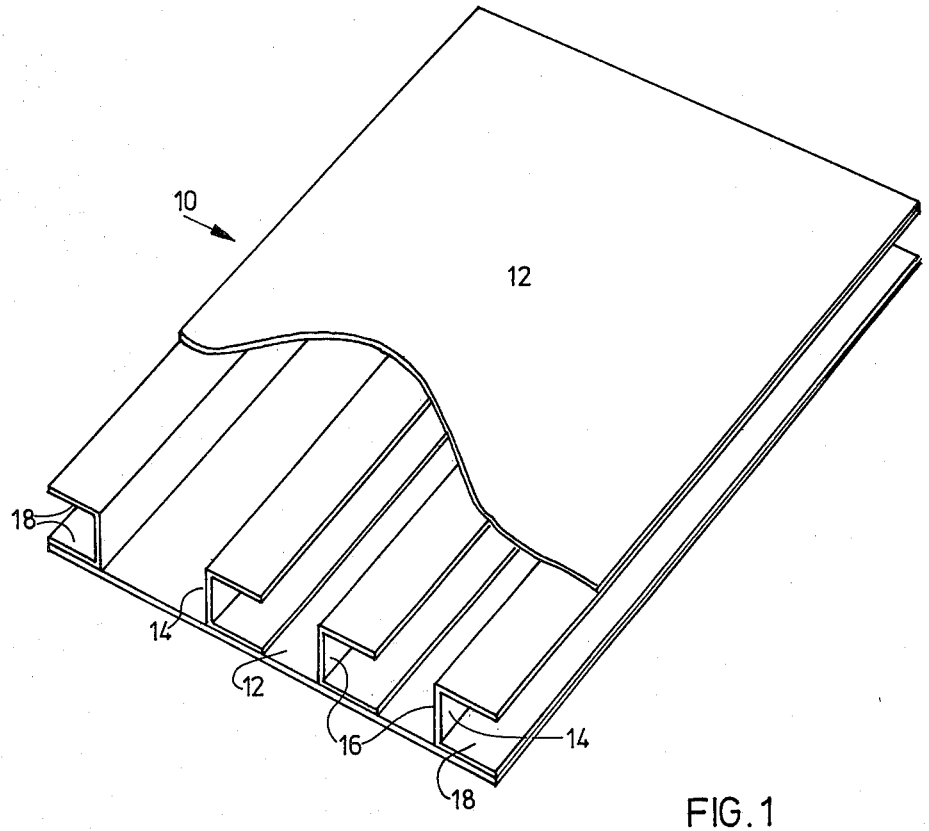
FIG. 1 is a perspective view of an insulating batt according to the present invention and shown in its as used condition.

The batt 10 has upper and lower rectangular sheets 12 joined by strips 14. The strips are substantially parallel to each other and of channel section, each having a central web 16 and two marginal portions 18 secured to respective ones of two sheets 12. The webs separate the sheets 12 when the batt is in the condition shown in FIGS. 1 and 3 so that an insulating air cavity 19 is formed between the sheets 12. This separation is achieved after movement of the sheets 12 from the position shown in FIG. 2.

Figure 3:
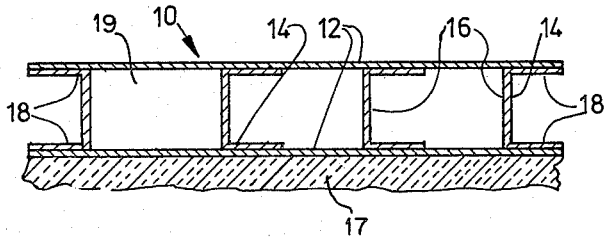
FIG. 3 is a view similar to that of FIG. 2, showing the batt in the condition of FIG. 1.
Figure 2:
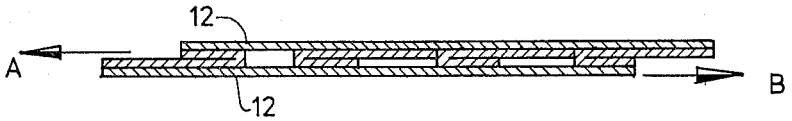
FIG. 2 is an end section of the batt of FIG. 1 shown in its position for transportation or storage.

The sheets 12 are moved from the position shown in FIG. 2 to that shown in FIGS. 1 and 3 by pulling the upper sheet in the direction of arrow A, relative to the lower sheet, and/or by pulling the lower sheet in the direction of arrow B.

The sheets 12 are formed of a heat reflective insulating material. More particularly, they comprise a layer of paper coated or impregnated with a bituminous or fire resistant material, and reflective aluminium foils over each surface. The upper sheet 12 has aluminium foil to its outer face and the sheet 12 to the bottom of the batt 10 has aluminium foil to both faces. However, metal may be provided over the outer surfaces only of both sheets or over both surfaces of the bottom sheet 12 and the outer surface only of the upper sheet 12.

The strips 14 may be formed of similar material. However, to permit improved bonding between the strips and the sheets, the surface of each marginal portion in contact with a sheet 12 may be free of metal or have the metal removed therefrom. The marginal portion may be bonded to the sheets by means of a suitable adhesive or by heat sealing of a thermoplastic film provided therebetween.

The thickness and/or material of construction of the sheets and strips preferably is such that the batt has sufficient stiffness so as to be self-supporting. The stiffness preferably also is such that when the sheet is moved from the condition shown in FIG. 2 to that of FIG. 1, the sheets are retained in spaced relation. The webs preferably are substantially perpendicular to the sheets when the latter are spaced as required and, to achieve this, it may be necessary to pull the sheets (in the direction of arrows A and/or arrow B) so that the webs initially move to an over centre position and recover to such perpendicular relation when released due to recovery of material of the strips.

The insulation batt of the present invention is found to provide a significant improvement in insulating efficiency over conventional insulation. The following table compares heat transmission ("U" values in B.T.U./sq. ft./per °F. temperature difference) through the ceiling of a dwelling having a tiled roof, during summer months of a batt of the above form, in which sheets 12 are of SIZALATION 423 with a 25 mm spacing therebetween (and typically of approximately 18 inches by 48 inches) with existing types of insulation.

| | No Insulation | 2 Inch Fiberglass Batt | Single Layer Sizalation 423 | Batt of Present Invention |
|---|---|---|---|---|
| U Value* | 0.23 | 0.09 | 0.08 | 0.06 |
| X Reduction | — | 61 | 65 | 74 |

*Calculated in accordance with the recommendations of the C.S.I.R.O. Division of Building Research.

A comparable improvement is found to occur in winter, the "U" value for no insulation being 0.60 compared with 0.15 for such batt of the present invention a reduction of 75%.

In addition, the insulation batt may double as a ceiling panel in which case the lowermost sheet which forms the ceiling surface may have a layer of foamed plastics material 17, such as foamed polyurethane or polyethylene, adhered to it as is shown in FIG. 3. Other conventional ceiling panel coatings may likewise be used in conjunction with the batt.

Figure 10:
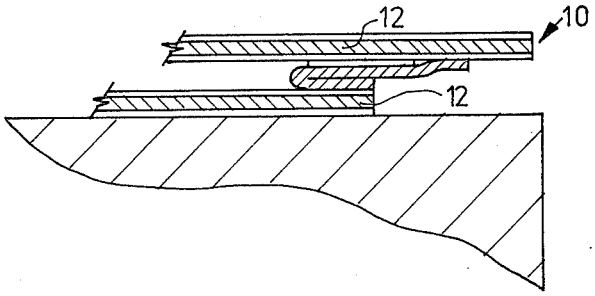
FIG. 10 is an enlarged fragmentary cross-section on the line 10—10 in FIG. 4.

FIGS. 4 to 9 illustrate a method of manufacture of a batt 10. In this batt, as shown in FIG. 10, the upper sheet 12 has a central paper laminate 12*a*, and inner and outer adhered aluminium foil laminates 12*b* and 12*c*. Lower sheet 12 is similarly formed. The strips 14 are of two part construction having one part in the form of a web 25 with a central portion 25*a* adhered to a second web 27. The strips 14 are as shown adhered to the sheets 12 at marginal portions 25*b*, 25*c* of web 25. Webs 25, 27 are both formed of paper, with only single layers 28 of aluminium foil each.

Figure 4:
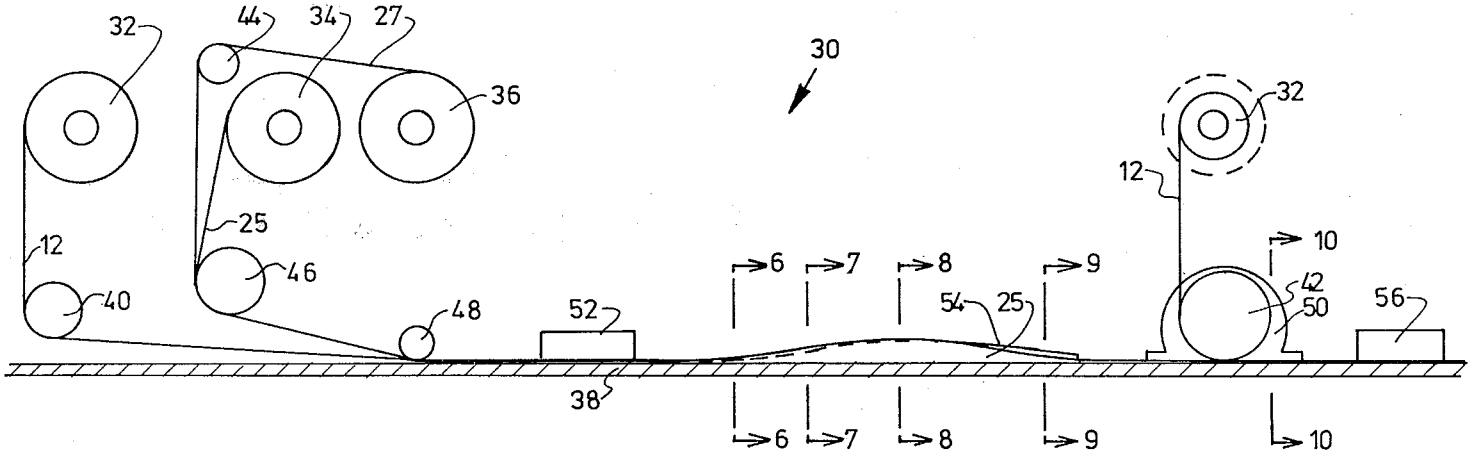
FIG. 4 is a diagrammatic side view of an apparatus useful for forming the batt of FIGS. 1 to 3.

In FIG. 4, an apparatus 30 for producing batt 10 of FIG. 10 is shown. The sheets 12 are taken from respective rolls 32 and the webs 25, 27 are taken from rolls 34, 36 respectively. The roll 32 for the lower sheet 12 is supported, by means not shown, at one end of the apparatus so as to extend transversely of an elongate bed 38. Material is unwound from this, passed around an end roller 40 onto the bed 38, and along the bed to the opposite end of the apparatus. Similarly, material to form the upper sheet 12 is taken from its roller 32, passed around a roller 42 to be laid over the lower sheet 12 on the bed. This roller 32 is, however, towards the rear end of the apparatus.

Figure 5:
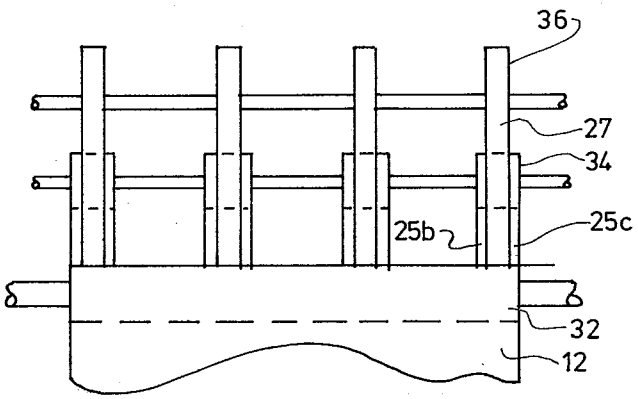
FIG. 5 is a fragmentary perspective view approximately in the direction of the arrow A in FIG. 4.
Figure 6:
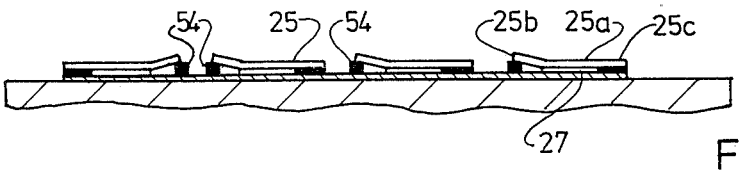
FIGS. 6 to 9 are cross-sections on the lines 6—6, 7—7, 8—8, respectively, in FIG. 4.
Figure 7:
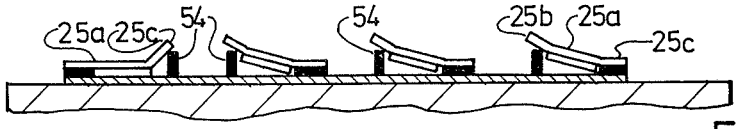
Figure 8:
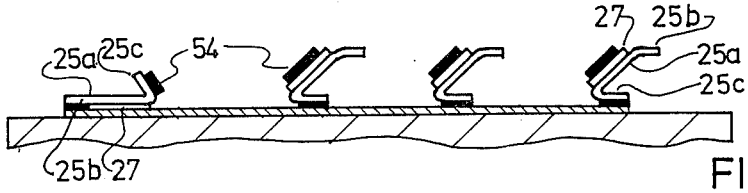
Figure 9:
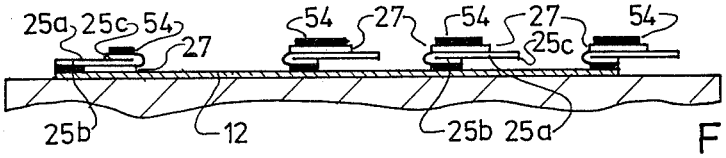
Figure 11:
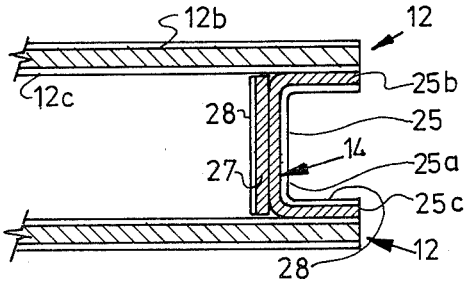
FIG. 11 is a fragmentary view like FIG. 10 but showing the batt in condition for use.

There is a roll 34 and a roll 36 formed at strip 14. Rolls of each pair are arranged as best shown in FIG. 5, that is to say, at corresponding locations transversely of the apparatus. Material from the rolls is taken around rollers 44, 46, and laid onto the lower sheet 12 before juxtaposition thereon of the upper sheet. The outwardly facing surface of each web 25, as wound on roll 34, is coated with a heat settable adhesive. The rolls 34, 36 are so aligned that each web 27 is laid onto its respective web 25 as these leave the rollers with marginal portions 25*b* and 25*c* defined to either side thereof. The so juxtaposed webs 25, 27, after passing around roller 46, pass under a compression roller 48 and then lengthwise of the apparatus to the rear end. The roller 42 is driven by a hydraulic motor 50 so that the juxtaposed webs 25, 27 and sheets 12, are driven by contact with roller 42 to cause the various rolls of material to be unwound to pass this material through the apparatus. After the webs 25, 27 have been engaged on the upper surfaces of lower sheet 12, the so layered material passes a plurality of heating elements 52 which are located in substantially fixed positions relative to the bed 38 but rest by their own weight only upon the upper surface of each web 25 so as to overlie only the respective web portion and 25*c* and 25*a*, except for that web to the extreme left as viewed in FIGS. 5 to 9, which has its portions 25*a*, 25*b* so engaged. This effects heat sealing of the so engaged portions to adhere the webs 25 to the lower sheet 12 and to adhere the portions 25*b* to the web 27. Thereafter as the so adhered web and lower sheet move along bed 38, the webs are twisted and folded about the junction between portions 25*a*, 25*c*, for the right-hand webs and about the junction between portions 25*a*, 25*c* for the extreme left webs 25, 27. This folding is effected by guide plates 54 which are shaped to engage the webs 27 as shown in FIGS. 6 to 8. The folding is substantially completed as the bent over webs pass under roller 42 and this roller presses the upper sheet 12 into contact with the webs 25, 27 and with sheet 12.

A plurality of heating devices 56 are disposed immediately behind roller 42 and positioned to heat seal the then uppermost portions 27*b* of the right-hand webs 27 and web 27*c* of the left-hand web 27 to the upper sheet 12 to complete the assembly. The apparatus 30 thus continuously produces insulation material which can by guillotining, be formed into batts 10 as it moves off the end of the bed 38. The adhesive is preferably polyethylene film of 0.0005 thickness which may be laminated onto the material to form strips 16. This material is preferred because it is impervious to moisture.

The described arrangement has been advanced merely by way of explanation and many modifications may be made thereto without departing from the spirit and scope of the invention as defined in the appended claims.

I claim:

1. An insulation batt comprising:

two rectangular sheets of heat reflecting material; and a plurality of strips secured to said sheets and positioned between said sheets and securing said sheets in overlapping substantially parallel relation, said strips extending in substantially parallel spaced relation with and between said sheets, said strips permitting relative movement of said sheets whereby either one or both of the sheets can be moved from a first position in which the sheets are in substantially face to face contact but wherein one longitudinal edge portion of each sheet, which extends in the same direction as said strips, overlaps a longitudinal edge portion of the other strip, to a second position in which the sheets are spaced from one another and wherein the said longitudinal edge portions no longer overlap, said second position providing an insulating air space between the sheets, said strips and said sheets being formed of laminated paper and metal foil and wherein:

said strips are made of a continuous strip of material shaped, when said sheets are in said second position, to form a C-shaped channel with squared corners, the center portion of said channel extending edgewise between said sheets, and each leg portion of said channel extending parallel to, and affixed to the respective one of, said sheets;

said batt is of predetermined width, and said channels extend lengthwise thereof; and the strips adjacent the longitudinal edges of said batt have their channel legs extending in an outwardly direction.

2. The batt as claimed in claim 1, wherein said sheets are formed of paper with metal foil laminated to both sides thereof.

3. The batt as claimed in claim 1 or claim 2, wherein one of the sheets has a layer of foamed plastics material adhered to the exterior surface thereof.

4. The batt as claimed in claim 1, wherein said strips are secured to the sheets by heat activatable adhesive.

* * * * *